US006677698B2

(12) United States Patent
Labarge et al.

(10) Patent No.: US 6,677,698 B2
(45) Date of Patent: Jan. 13, 2004

(54) SPARK PLUG COPPER CORE ALLOY

(75) Inventors: William J. Labarge, Bay City, MI (US); Conrad H. Anderson, Davison, MI (US); John Giacchina, Davison, MI (US); David A. Smith, Fenton, MI (US); David J. Draeger, Flushing, MI (US)

(73) Assignee: Delphi Technologies, Inc., Troy, MI (US)

( * ) Notice: Subject to any disclaimer, the term of this patent is extended or adjusted under 35 U.S.C. 154(b) by 391 days.

(21) Appl. No.: 09/738,560

(22) Filed: Dec. 15, 2000

(65) Prior Publication Data

US 2002/0074919 A1 Jun. 20, 2002

(51) Int. Cl.[7] ..... H01T 13/39
(52) U.S. Cl. ..... 313/141; 313/144
(58) Field of Search ..... 313/141, 326, 313/311, 11.5, 130, 137, 143, 144; 445/7

(56) References Cited

U.S. PATENT DOCUMENTS

| | | | | | |
|---|---|---|---|---|---|
| 2,266,318 | A | * | 12/1941 | Heller | 420/443 |
| 2,391,455 | A | * | 12/1945 | Hensel | 313/142 |
| 2,391,456 | A | * | 12/1945 | Hensel | 313/11.5 |
| 2,874,208 | A | * | 2/1959 | Pierce | 174/152 S |
| 3,061,756 | A | * | 10/1962 | Henderson | 313/145 |
| 3,108,905 | A | * | 10/1963 | Comer | 313/130 |
| 4,369,343 | A | * | 1/1983 | Sone et al. | 200/19.4 |
| 4,786,267 | A | * | 11/1988 | Toya et al. | 445/7 |
| 6,472,801 | B1 | * | 10/2002 | Matsubara et al. | 313/141 |
| 2002/0079800 | A1 | * | 6/2002 | Miyashita et al. | 313/143 |
| 2003/0059335 | A1 | * | 3/2003 | Quadadakkers et al. | 420/40 |

FOREIGN PATENT DOCUMENTS

| | | | |
|---|---|---|---|
| JP | 5-198349 | * | 8/1993 |
| JP | 9-291327 | * | 11/1997 |
| JP | 11-12670 | * | 1/1999 |

OTHER PUBLICATIONS

Joanna R. Groza, "Microstructural Features of a New Precipitation–Strengthened Cu–8Cr–4Nb Alloy", Materials Characterization, vol. 31, pp. 133–141, (1993).

E. Batawi, et al., "Thermomechanical processing of Spray–Formed Cu–Cr–Zr Alloy", Scripta Metallurgica; vol. 29, pp. 765–769 (1993).

J. Stobrawa, et al., "Rapidly Solidified Strips of Cu–Cr and Cu–Cr–Zr Alloys", 1/685, Institute of Non–ferrous Metals, Gliwice, Poland.

Ken R. Anderson, et al., "Microstructural evolution and thermal stability of precipitation–strengthened Cu–8Cr–4Nb alloy", Materials Science and Engineering, A169 (1993), pp. 167–175.

(List continued on next page.)

*Primary Examiner*—Jay Patidar
(74) *Attorney, Agent, or Firm*—Jimmy L. Funke

(57) ABSTRACT

A spark plug electrode is disclosed. The electrode comprises, based upon the total weight of the electrode, about 83 wt. % to about 96.8 wt. % copper, about 3.0 wt. % to about 9.0 wt. % chromium, and about 0.2 wt. % to about 8.0 wt. % niobium. A spark plug is also disclosed. The spark plug comprises a shell disposed in contact with an insulator body. A center electrode is disposed at a lower end of the insulator body. A side electrode is also disposed at a lower end of the shell. This side electrode is coaxially aligned with the center electrode. At least one of the center electrode and the side electrode comprises a core composition of about 83 wt. % to about 96.8 wt. % copper, about 3.0 wt. % to about 9.0 wt. % chromium and about 0.2% to about 8.0% niobium, based upon the total weight of the composition. A resistor section is also disposed in electrical communication with the center electrode.

20 Claims, 1 Drawing Sheet

OTHER PUBLICATIONS

David A. Ellis, et al., "Production and Processing of Cu–Cr–Nb Alloys", NASA Techniocal Memorandum 102495, pp. 1–12, (Jan. 1990).

C. Bubois, et al., "Influence of the Threshold Stress on the Creep Properties of a Cu–Cr–Zr Alloy Containing Dispersoid Particles", Scripta Metallurgica et Materialia, vol. 30, No. 7, pp. 827–832 (1994).

I. Anzel, et al., "Cellular solidification during continuous casting of a Cu–Cr–Zr alloy, Part 1: Conditions for Cellular morphology", Metallwissenschaft und Technik.

Kenneth Reed Anderson, "High Temperatures Coarsening of Cr2Nb Precipitates in Cu–8 Cr–4 Nb Alloy", NASA Contractor Report 198492, Jun. 1996.

David L. Ellis, "Mechanical Properties of Cu–Cr–Nb Alloys", Case Western Reserve University, NASA Lewis Research Center, Cleveland, OH, Paper 7, pp. 1–11.

K.T. Chiang, "Oxidation Behavior of A Cu–8Cr–4Nb Alloy", The Boeing Company, Rocketdyne Propulsion & Power Systems, 6633 Canoga Avenue, Canoga Park, CA 91309–7922, Electrochemical Society Proceedings, vol. 98–9, pp. 489–499.

Ken R. Anderson, "High–Performance Disperation–Strengthened Cu–8 Cr–4 Nb Alloy", Metallurgical and Materials Transactions A, vol. 26A, Sep. 1995, pp. 2197–2206.

Ken R. Anderson, "Microstructureal Refinement and Strengthening of Cu–4 Cr–2 Nb Alloy by Mechanical Milling", Scripta Materialia, vol. 37, No. 2, pp. 179–185 (1997).

D.L. Zhang, et al., Abstract of Materials Science and Engineering A, vol. A226, No. 1–2, pp. 99–108 (Jun. 30, 1999).

K. Mihara, et al., Abstract of Journal of the Japan Institute of Metals, vol. 62, No. 7, pp. 599–606, (Jul. 1998).

T. V. Golub, et al., Abstract of Bulletin of the Russian Academy of Science, vol. 57, No. 11, pp. 1923–1926, (1993).

K Rust, Abstract of Zis Mitteilungen, vol. 13, No. 10, pp. 1488–1492 (Oct. 1971).

* cited by examiner

SPARK PLUG COPPER CORE ALLOY

TECHNICAL FIELD

The present disclosure relates to spark plugs and more particularly, to spark plugs having a copper core.

BACKGROUND

Conventional spark plugs have primarily two functions in an internal combustion engine. The first is to efficiently ignite the fuel/air mixture and the second is to remove the heat out of the combustion chamber. A sufficient amount of voltage must be supplied by the ignition system to cause a spark to jump across the spark plug gap, creating an electrical performance. Additionally, the temperature of the spark plug's firing end must be kept low enough to prevent pre-ignition, but high enough to prevent fouling of the spark plug.

A conventional spark plug typically includes a ceramic insulator body having a center electrode and an outer metal shell assembled around the insulator body having a side electrode (or side wire) that is bent in an L-shape. The side electrode cooperates with the center electrode to generate a spark therebetween when an electrical voltage is applied between the electrodes.

The side electrode is generally a composite electrode having a copper (Cu) (or copper alloy) core. In one conventional spark plug, the side electrode has been created from a copper alloy combined with chromium (Cr) and zirconia (Zr). However, the Cu, Cr, and Zr are difficult to disperse uniformly. Additionally, the zirconia is a poor electrical and thermal conductor and it interferes with the strong Cu—Cr bonding. As a result, area of high concentrations of zirconia greatly decrease the electrical conductivity, the thermal conductivity and the strength of the alloy. Also, areas of low concentration of zirconia do not sufficiently restrict grain growth.

What is needed in the art is composition for the side electrode that sufficiently conducts electricity and is durable.

SUMMARY

The deficiencies of the above-discussed prior art are overcome or alleviated by the spark plug copper alloy. A spark plug electrode, based upon the total weight of the electrode, is disclosed. The spark plug electrode comprises about 83 wt. % to about 96.8 wt. % copper, about 2.0 wt. % to about 9.0 wt. % chromium, and about 0.2 wt. % to about 8.0 wt. % niobium.

A spark plug is also disclosed. The spark plug comprises a shell disposed in contact with an insulator body. A center electrode is disposed at a lower end of the insulator body. A side electrode is also disposed at a lower end of the shell. This side electrode is coaxially aligned with the center electrode. At least one of the center electrode and the side electrode comprises a core composition of about 83 wt. % to about 96.8 wt. % copper, about 3.0 wt. % to about 9.0 wt. % chromium and about 0.2% to about 8.0% niobium, based upon the total weight of the composition. A resistor section is also disposed in electrical communication with the center electrode.

BRIEF DESCRIPTION OF THE DRAWINGS

Referring now to the figure, which is meant to be exemplary, and not limiting.

DETAILED DESCRIPTION OF THE PREFERRED EMBODIMENT

Figure 1:
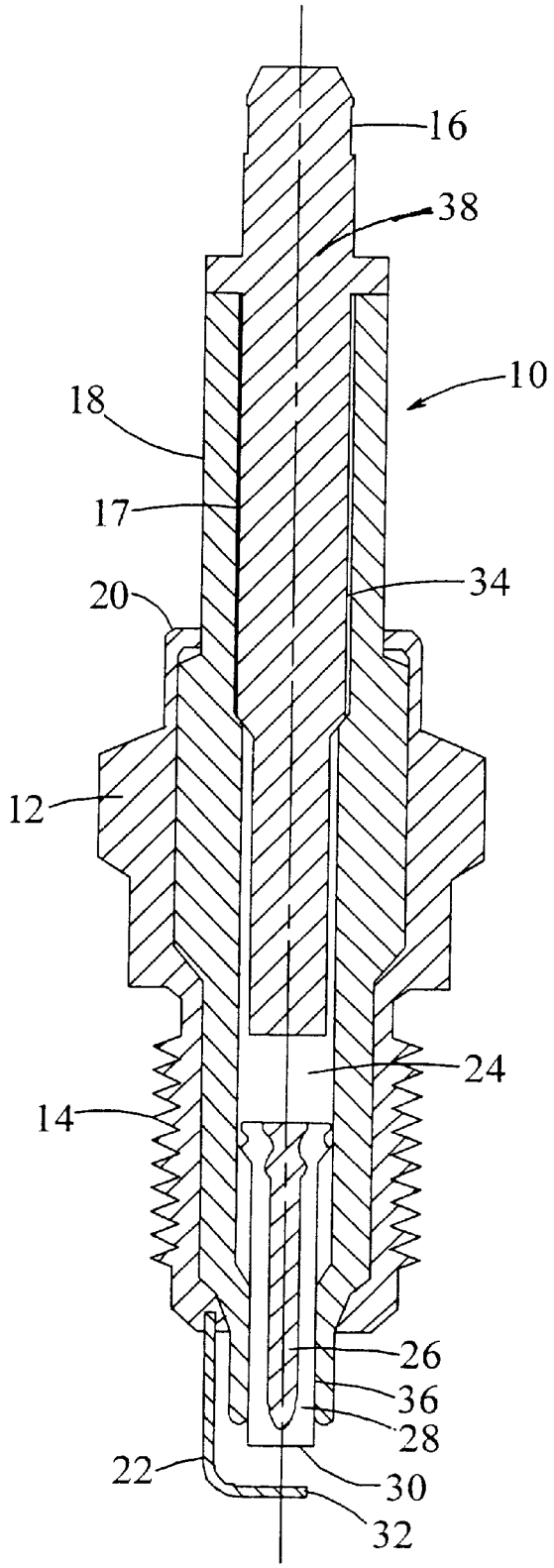
FIG. 1 is a side view of an exemplary spark plug.

A spark plug 10 is illustrated in FIG. 1. As with spark plugs typically used with internal combustion engines, the spark plug 10 includes a shell 12, generally formed from steel. External threads 14 are formed at one end of the shell 12 for the purpose of installing the spark plug 10 into a threaded hole in a wall of a combustion chamber within an internal combustion engine (not shown). An insulator body 18, generally formed from a ceramic material such as alumina ($Al_2O_3$), is secured within the shell 12 in any suitable manner, such as by crimping. A gasket 20 of a suitable temperature resistant material, such as copper or steel, can be provided between the shell 12 and the insulator body 18 to help create a gas tight seal therebetween. The insulator body 18 projects through the end of the shell 12 opposite the threads 14. The portion of the insulator body 18 which projects from the shell 12 has a passage 17 which receives an upper terminal 16, by which an electric current can be supplied to the spark plug 10. Located at the end of the spark plug 10 opposite the upper terminal 16 is a side electrode 22. As is conventional, the side electrode 22 may be an L-shaped metal member welded to the shell 12, allowing the shell 12 to conduct electric current and heat to the engine block (not shown).

The insulator body 18 surrounds the center electrode 34, which is comprised of an upper portion 38, a lower portion 36, and a resistor section 24 comprised of a glass seal and the like. Within the lower portion 36 of the center electrode 34 is a core 26 in an oxidation-resistant sheath 28 (e.g., nickel or nickel alloy sheath). The side electrode 22 includes an outermost end 32 that is positioned in cooperative relation (or coaxially aligned) to the tip 30 of the center electrode 34.

While nickel (inconel) coated pure copper (Cu) is an ideal material for the side electrode 22 core and the center electrode core 26 because of its thermal and electrical conductivity, the use of copper does not provide sufficient structural rigidity at high temperatures and does not inhibit the formation of grain growth and void formation. Therefore, copper alloys have been used for increased strength at higher temperatures, reduced grain growth, and reduced void formation, but still retain the thermal and electrical conductivity benefits of copper. Materials highly conductive of electricity, including chromium (Cr), nickel (Ni), titanium (Ti), silicon (Si), manganese (Mn), iron (Fe), and carbon (C), either alone or combined, have been used with copper. A copper-chromium-zirconium (Cu—Cr—Zr) electrode has been created, but the use of even small amounts of Zr decreases the electrical and thermal conductivity, since Zr does not disperse well, and it interferes with the strong Cu—Cr bonding. Since high concentrations of Zr greatly decrease the electrical conductivity, the thermal conductivity, and the strength of the alloy, another alternative was needed.

Because of the extreme conditions that a spark plug is exposed to, the material for the electrodes should have high strength at elevated temperatures, corrosion resistance, and also should maintain thermal and electrical conductivity at high temperatures. A material that is a good electrical conductor, is an excellent thermal conductor, is compatible with the nickel based stainless steel protective coating, and imparts strength to the alloy is the element Niobium (Nb).

Niobium can be used in the copper alloy of the center electrode 34 and/or the side electrode 22. The concentration of Nb in a Cu—Cr—Nb alloy can be about 0.2 weight percent (wt. %) to about 8.0 wt. %, with about 3.5 wt. % to about 7.0 wt. % preferred, and about 5.0 wt. % to about 6.0 wt. % especially preferred, based upon the total weight of the alloy. Cu can be present at a concentration of about 83 wt. % to about 96.8 wt. %, with about 83 wt. % to about 92 wt. % preferred, and about 87 wt. % to about 89 wt. % especially preferred, based upon the total weight of the alloy. Cr can be at a concentration of about 3.0 wt. % to about 9.0 wt. %, with about 3.5 wt. % to about 7.5 wt. % preferred and about 6.0 wt. % to about 7.0 wt. % especially preferred, based upon the total weight of the alloy. Cu—Cr—Nb alloys are commercially available from Special Metals Corp., New Hartford, N.Y.

The Cu—Cr—Nb alloy may additionally comprise a coating. For example, the alloy can be clad with an oxidation resistant material. Possible materials comprise steels, nickel, and the like, as well as combinations and alloys comprising at least one of the foregoing materials.

In comparison to Cu—Cr—Zr alloys, the Cu—Cr—Nb alloys can have finer grain size at higher temperatures (less than about 2.7 microns after about 100 hours at about 1,060° C.). Essentially, Cu—Cr—Nb has no significant Cu grain growth up to about 98 percent of the melting temperature (Tm) (i.e., about 1,035° C.). Cu—Cr—Nb has about 75% of the original hardness (or greater) after about 100 hours at about 1,000° C. Cu—Cr—Nb has about 70% or more of the original strength after about 100 hours at about 1,000° C. Cu—Cr—Nb has much better hydrogen embrittlement resistance than Cu or Cu—Cr—Zr.

Nb alloys have better electrical conductivity, better strength, better fatigue life, retain more hardness, retain higher yield strength, are more creep resistant, and are more resistant to hydrogen embrittlement than Cu—Cr—Zr alloys. The electrical conductivity of Cu—Cr—Nb (2.0 Nb wt. %) is about 90% of pure Cu. The thermal conductivity of Cu—Cr—Nb is about 96% of pure Cu. But unlike copper, which has a tendency to boil away at high temperatures leaving large voids, the Cu—Cr—Nb does not boil away. The tensile strength of Cu—Cr—Nb is "significantly" better than Cu, or Cu—Cr, or Cu—Cr—Zr at temperatures above about 700° C. The tensile strength of Cu—Cr—Zr is about 100 megapascals (MPa) at about 575° C., while the tensile strength of Cu—Cr—Nb is about 100 MPa or greater at over about 700° C. Meanwhile, the yield strength of Cu—Cr—Zr is about 100 MPa at about 450° C., while the yield strength of Cu—Cr—Nb is about 100 MPa at about 700° C. Additionally, the fatigue life of the Cu—Cr—Nb alloy is about 100% to about 200% greater than Cu—Cr—Zr. For a given spark plug life (e.g., about 1,000 hours of use), Cu—Cr—Nb could support up to about 160% more stress than Cu—Cr—Zr. For a given stress (e.g., 100 MPa) and temperature (e.g., about 700° C.), Cu—Cr—Nb has about 100% to about 250% advantage in creep life over the Cu—Cr—Zr spark plug.

The Cu—Cr—Nb alloy creates a spark plug electrode that is thermally and electrically conductive at high temperatures and imparts strength to the alloy creating a cost efficient and durable electrode.

While preferred embodiments have been shown and described, various modifications and substitutions may be made thereto without departing from the spirit and scope of the invention. Accordingly, it is to be understood that the apparatus has been described by way of illustration only, and such illustrations and embodiments as have been disclosed herein are not to be construed as limiting to the claims.

What is claimed is:

1. A spark plug electrode, based upon the total weight of the electrode, comprising:

about 83 wt. % to about 96.8 wt. % copper;

about 3.0 wt. % to about 9.0 wt. % chromium; and about 0.2 wt. % to about 8.0 wt. % niobium.

2. The spark plug electrode of claim 1, wherein said copper is at about 83 wt. % to about 92 wt. %, said chromium is at about 3.5 wt. % to about 7.5 wt. %, and said niobium is at about 3.5 wt. % to about 7.0 wt. %.

3. The spark plug electrode of claim 1, wherein said copper is at about 87 wt. % to about 89 wt. %, said chromium is at about 6.0 wt. % to about 7.0 wt. %, and said niobium is at about 5.0 wt. % to about 6.0 wt. %.

4. The spark plug electrode of claim 1, wherein said electrode has less than about 2.7 microns grain size after about 100 hours at about 1,060° C.

5. The spark plug electrode of claim 1. wherein said electrode has about 75% or greater of an original hardness after about 100 hours at about 1,000° C.

6. The spark plug electrode of claim 1, wherein said electrode has a tensile strength of about 100 MPa or greater at temperatures of about 700° C.

7. A spark plug, comprising:

a shell disposed in contact with an insulator body;

a center electrode disposed at a lower end of said insulator body: a side electrode disposed at a lower end of said shell, wherein said side electrode and said center electrode are coaxially aligned; and a resistor section disposed in electrical communication with said center electrode;

wherein at least one of said center electrode and said side electrode comprises a core composition of about 83 wt. % to about 96.8 wt. % copper, about 3.0 wt. % to about 9.0 wt. % chromium and about 0.2% to about 8.0% niobium, based upon the total weight of the composition.

8. The spark plug of claim 7, wherein said composition, based upon the total weight of said composition, comprises said copper at about 83 wt. % to about 92 wt. %, said chromium at about 3.5 wt. % to about 7.5 wt. %, and said niobium at about 3.5 wt. % to about 7.0 wt. %.

9. The spark plug of claim 8, wherein said composition, based upon the total weight of said composition, comprises said copper at about 87 wt. % to about 89 wt. %, said chromium at about 6.0 wt. % to about 7.0 wt. %, and said niobium at about 5.0 wt. % to about 6.0 wt. %.

10. The spark plug of claim 7, wherein said at least one of said center electrode and said side electrode has less than about 2.7 microns grain size after about 100 hours at about 1,060° C.

11. The spark plug of claim 7, wherein said at least one of said center electrode and said side electrode has greater than about 75% of original hardness after about 100 hours at about 1,000° C.

12. The spark plug of claim 7, wherein said at least one of said center electrodes and said side electrodes has a tensile strength of about 100 MPa or greater at temperatures of about 700° C.

13. The spark plug of claim 7, wherein said at least one of said center electrodes and said side electrodes has a fatigue life of about 100% to about 200% greater than a Cu—Cr—Zr electrode.

14. The spark plug of claim 7, wherein said at least one of said center electrode and said side electrode can support up to about 160% more stress than a Cu—Cr—Zr electrode.

15. The spark plug of claim 7, wherein both of said center electrode and said side electrode comprise a core composition of about 83 wt. % to about 96.8 wt. % copper, about 3.0 wt. % to about 9.0 wt. % chromium and about 0.2% to about 8.0% niobium, based upon the total weight of the composition.

16. A spark plug electrode, based upon the total weight of the electrode, consisting essentially of:

about 83 wt. % to about 96.8 wt. % copper;

about 3.0 wt. % to about 9.0 wt. % chromium; and about 0.2 wt. % to about 8.0 wt. % niobium.

17. The spark plug electrode of claim 16, wherein said copper is at about 83 wt. % to about 92 wt. %, said chromium is at about 3.5 wt. % to about 7.5 wt. %, and said niobium is at about 3.5 wt. % to about 7.0 wt. %.

18. The spark plug electrode of claim 16, wherein said electrode has less than about 2.7 microns grain size after about 100 hours at about 1,060° C.

19. The spark plug electrode of claim 16, wherein said electrode has about 75% or greater of an original hardness after about 100 hours at about 1,000° C.

20. The spark plug electrode of claim 16, wherein said electrode has a tensile strength of about 100 MPa or greater temperatures of about 700° C.

* * * * *